US011564553B2

(12) United States Patent
Büsing et al.

(10) Patent No.: US 11,564,553 B2
(45) Date of Patent: Jan. 31, 2023

(54) DISH WASHER

(71) Applicant: SAMSUNG ELECTRONICS CO., LTD., Suwon-si (KR)

(72) Inventors: Johannes Büsing, Suwon-si (KR); Jisun Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 98 days.

(21) Appl. No.: 17/090,101

(22) Filed: Nov. 5, 2020

(65) Prior Publication Data

US 2021/0137345 A1 May 13, 2021

(30) Foreign Application Priority Data

Nov. 12, 2019 (KR) ..... 10-2019-0144171

(51) Int. Cl.
*A47L 15/22* (2006.01)
*A47L 15/42* (2006.01)

(52) U.S. Cl.
CPC ..... *A47L 15/4225* (2013.01); *A47L 15/22* (2013.01); *A47L 15/4202* (2013.01); *A47L 15/4204* (2013.01); *A47L 15/4206* (2013.01); *A47L 15/4209* (2016.11); *A47L 15/4214* (2013.01); *A47L 15/4219* (2013.01); *A47L 15/4246* (2013.01); *A47L 15/4278* (2013.01); *A47L 15/4285* (2013.01); *A47L 15/4287* (2013.01); *A47L 15/4297* (2013.01); *A47L 2401/12* (2013.01); *A47L 2501/06* (2013.01)

(58) Field of Classification Search
None
See application file for complete search history.

(56) References Cited

U.S. PATENT DOCUMENTS

| | | | |
|---|---|---|---|
| 4,279,384 | A | 7/1981 | Yamamoto |
| 5,076,456 | A | 12/1991 | Geyer |
| 9,833,120 | B2 | 12/2017 | Vallejo Noriega et al. |

FOREIGN PATENT DOCUMENTS

| | | | |
|---|---|---|---|
| EP | 2810595 | A1 | 12/2014 |
| EP | 2820997 | | 1/2015 |
| EP | 2384685 | | 8/2016 |
| KR | 10-1633933 | B1 | 6/2016 |
| KR | 10-1642701 | | 8/2016 |
| KR | 10-2016-0149674 | A | 12/2016 |
| KR | 10-1970517 | | 4/2019 |

OTHER PUBLICATIONS

International Search Report dated Feb. 26, 2021 from International Application No. PCT/KR2020/015753.

*Primary Examiner* — Levon J Shahinian
(74) *Attorney, Agent, or Firm* — Staas & Halsey LLP

(57) ABSTRACT

Provided is a structure of a sump assembly of a dishwasher. The dishwasher includes a tub forming a washing chamber, and a sump assembly provided at a lower side of the washing chamber and configured to store washing water in the washing chamber, wherein the sump assembly includes a sump housing having a water storage chamber storing the washing water and a sidewall portion forming the water storage chamber, and a heater provided on the sidewall portion to apply heat to the washing water stored in the sump assembly. The heater includes a planar heating element, and the planar heating element provided in a cylindrical shape forms the sidewall portion.

20 Claims, 10 Drawing Sheets

DISH WASHER

CROSS-REFERENCE TO RELATED APPLICATION

This application is based on and claims priority under 35 U.S.C. § 119 to Korean Patent Application No. 10-2019-0144171, filed on Nov. 12, 2019 in the Korean Intellectual Property Office, the disclosure of which is incorporated herein by reference.

BACKGROUND

1. Field

The disclosure relates to a dishwasher, and more specifically, to a sump structure disposed at a lower portion of the dishwasher.

2. Description of the Related Art

A dishwasher is a device that automatically cleans food debris from dishware using detergent and washing water.

The dishwasher includes a main body, a washing chamber formed by a tub disposed inside the main body, a storage container disposed inside the washing chamber to accommodate dishware, and a spray unit provided to spray washing water into the storage container.

The storage container is generally provided in two or three stage, and a plurality of the spray units may be arranged to correspond to respective storage containers to spray the washing water to an area where each storage container is disposed.

The dishwasher may include a sump formed at a lower end of a washing chamber such that washing water is collected in the sump.

The conventional dishwasher may include a heater that is separately provided from a sump and configured to heat water flowing through a water supply pipe. When the high-temperature washing water heated by the heater is supplied to the sump, the water may be filtered by a filter and then pass through a circulation pump. The heated washing water passing through the circulation pump may more easily wash dishware through a spray nozzle. The heated washing water may decompose dirt or sterilize microorganisms inside the sump or filter. However, the heater separately provided from the sump may cause heat loss. When the separate heater is coupled to a pump, pressure loss of the pump may occur, and the energy efficiency of the pump may be lowered.

SUMMARY

According to an aspect of the disclosure, there is provided a dishwasher including: a tub forming a washing chamber; and a sump assembly provided at a lower side of the washing chamber and configured to store washing water in the washing chamber, wherein the sump assembly includes: a sump housing having a water storage chamber storing the washing water and a sidewall portion forming the water storage chamber; and a heater provided on the sidewall portion to apply heat to the washing water stored in the sump assembly.

The heater may include a planar heating element.

The heater may be provided by forming the planar heating element in a cylindrical shape.

The sump housing may include: an upper sump housing arranged at an upper end portion of the water storage chamber, and including an inclined portion configured to guide the washing water into the sump assembly and an opening communicating the washing chamber with the water storage chamber; a lower sump housing forming a bottom portion of the water storage chamber; and an intermediate sump housing connecting the upper sump housing to the lower sump housing, and forming the sidewall portion.

The sump assembly may include an upper sealing member arranged at a connecting portion between the upper sump housing and the intermediate sump housing; and a lower sealing member arranged at a connecting portion between the intermediate sump housing and the lower sump housing.

The upper sump housing may include an upper groove in which the upper sealing member is accommodated, the lower sump housing may include a lower groove in which the lower sealing member is accommodated, and both ends of the intermediate sump housing may be seated in the upper groove and the lower groove.

The upper sump housing may include a first coupling portion protruding from a body of the upper sump housing, and the lower sump housing may include a second coupling portion protruding from a body of the lower sump housing to correspond to the first coupling portion, and the first coupling portion and the second coupling portion may be fastened to each other through a coupling member so that the upper sump housing, the intermediate sump housing, and the lower sump housing are fixed.

The dishwasher may further include a spray unit configured to spray washing water to wash dishware, wherein the sump assembly may further include: a fine filter provided at an upper side of the sump housing, and having an opening communicating the washing chamber with the water storage chamber; a coarse filter provided in a cylindrical shape and mounted in the opening; a micro filter mounted inside the water storage chamber to form a dirt collecting chamber for collecting dirt together with a part of the bottom portion of the sump housing, and having a cylindrical shape; and a circulation chamber formed by an outer side of the micro filter and the sidewall portion, and provided to circulate the washing water to the spray unit, wherein the heater heats the washing water of the circulation chamber.

The sump assembly may include the intermediate sump housing that is eccentrically disposed with respect to the micro filter.

The sump assembly may further include a sensor configured to measure a temperature of the washing water in the water storage chamber, and a controller configured to adjust a temperature of the heater.

The micro filter may include a filter net configured to filter out dirt and a filter frame provided in a cylindrical shape and supporting the filter net, the filter frame may have one end accommodated in a micro filter fitting groove provided in the lower sump housing and an other end provided to come in contact with and communicate with the opening of the fine filter, and the micro filter may have a vertical length longer than a vertical length of the intermediate sump housing.

A ratio of a diameter of the micro filter to a diameter of the intermediate sump housing may have a value in a range of 0.5 to 0.8.

According to another aspect of the disclosure, there is provided a sump assembly for storing washing water of a dishwasher, the sump assembly including: a water storage chamber configured to store washing water; a first sump housing arranged at an upper end portion of the water storage chamber, and including an inclined portion configured to guide the washing water into the sump assembly and an opening communicating the washing chamber with the water storage chamber; a second sump housing forming a bottom portion of the water storage chamber; and a third sump housing connecting the first sump housing to the second sump housing, and forming a sidewall portion of the water storage chamber, wherein the third sump housing includes a planar heating element.

The third sump housing may be provided by forming the planar heating element in a cylindrical shape.

The sump assembly may further include: an upper sealing member arranged at a connecting portion between the first sump housing and the third sump housing; and a lower sealing member arranged at a connecting portion between the third sump housing and the second sump housing to prevent washing water from leaking to the outside.

The first sump housing may include an upper groove in which the upper sealing member is accommodated, the second sump housing may include a lower groove in which the lower sealing member is accommodated, and both ends of the third sump housing may be seated in the upper groove and the lower groove, respectively, while pressing the upper sealing member and the lower sealing member.

The first sump housing may include a first coupling portion protruding from a body of the first sump housing, and the second sump housing may include a second coupling portion protruding from a body of the second sump housing to correspond to the first coupling portion, and the first coupling portion and the second coupling portion may be fastened to each other through a coupling member so that the first sump housing, the second sump housing, and the third sump housing are fixed.

The sump assembly may further include: a fine filter provided at an upper side of the first sump housing, and having an opening communicating the washing chamber with the water storage chamber; a coarse filter provided in a cylindrical shape and mounted in the opening; and a micro filter mounted inside the water storage chamber to form a dirt collecting chamber for collecting dirt together with a part of the bottom portion of the second sump housing, and having a cylindrical shape; and a circulation chamber formed by an outer side of the micro filter and the sidewall portion, and provided to circulate the washing water to a spray unit configured to spray washing water such that the dishwasher washes dishware, wherein the planar heating element may heat the washing water of the circulation chamber.

The third sump housing may be eccentrically disposed with respect to the micro filter.

The sump assembly may further include a sensor configured to measure a temperature of the washing water in the water storage chamber, and a controller configured to adjust a temperature of the heater.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
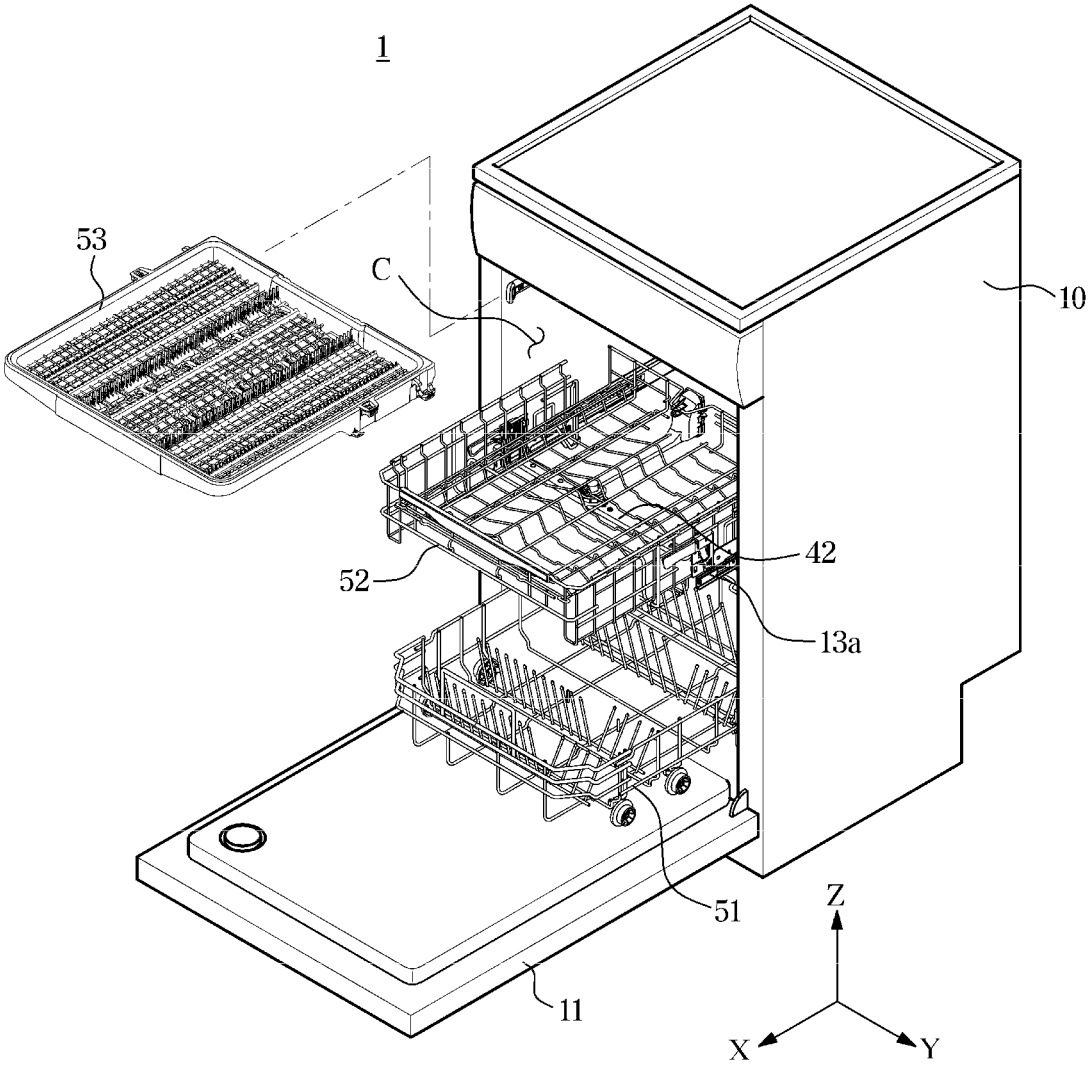
FIG. 1 is a schematic perspective view illustrating a dishwasher according to an embodiment of the disclosure.

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to restrict and/or limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, area, layer or section discussed below could be termed a second element, component, area, layer or section without departing from the teachings of the disclosure. Descriptions shall be understood as to include any and all combinations of one or more of the associated listed items when the items are described by using the conjunctive term "~and/or~," or the like.

Meanwhile, the terms "front", "rear", "upper", "lower", "top", and "bottom" as herein used are defined with respect to the drawings, but the terms may not restrict the shape and position of the respective components.

Therefore, it is an object of the disclosure to provide a dishwasher having a reduced overall volume by minimizing the volume of a sump.

It is another object of the disclosure to provide a dishwasher including a sump having an improved structure.

It is another object of the disclosure to provide a dishwasher in which a part of the sump forms a heater so that the thermal efficiency of the dishwasher is increased and pressure loss of a pump is reduced.

Specifically, referring to FIG. 1, the direction in which a door 11 of a dishwasher 1 is disposed is defined as the front, and based on the front, rear, left and right sides, and upper and lower sides are defined.

Hereinafter, embodiments of the disclosure will be described in detail with reference to the accompanying drawings.

Figure 2:
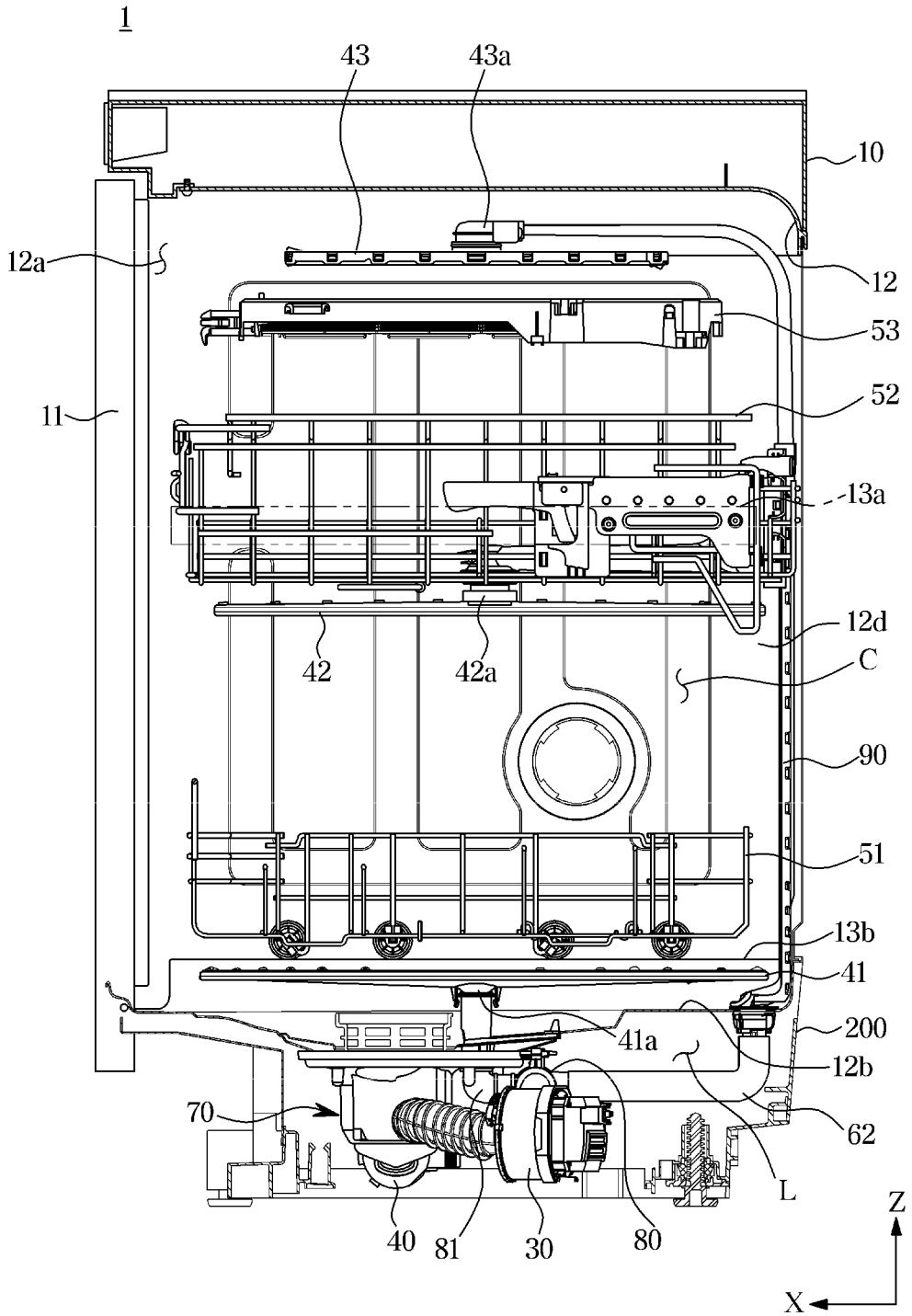
FIG. 2 is a cross-sectional view illustrating the dishwasher shown in FIG. 1.
Figure 3:
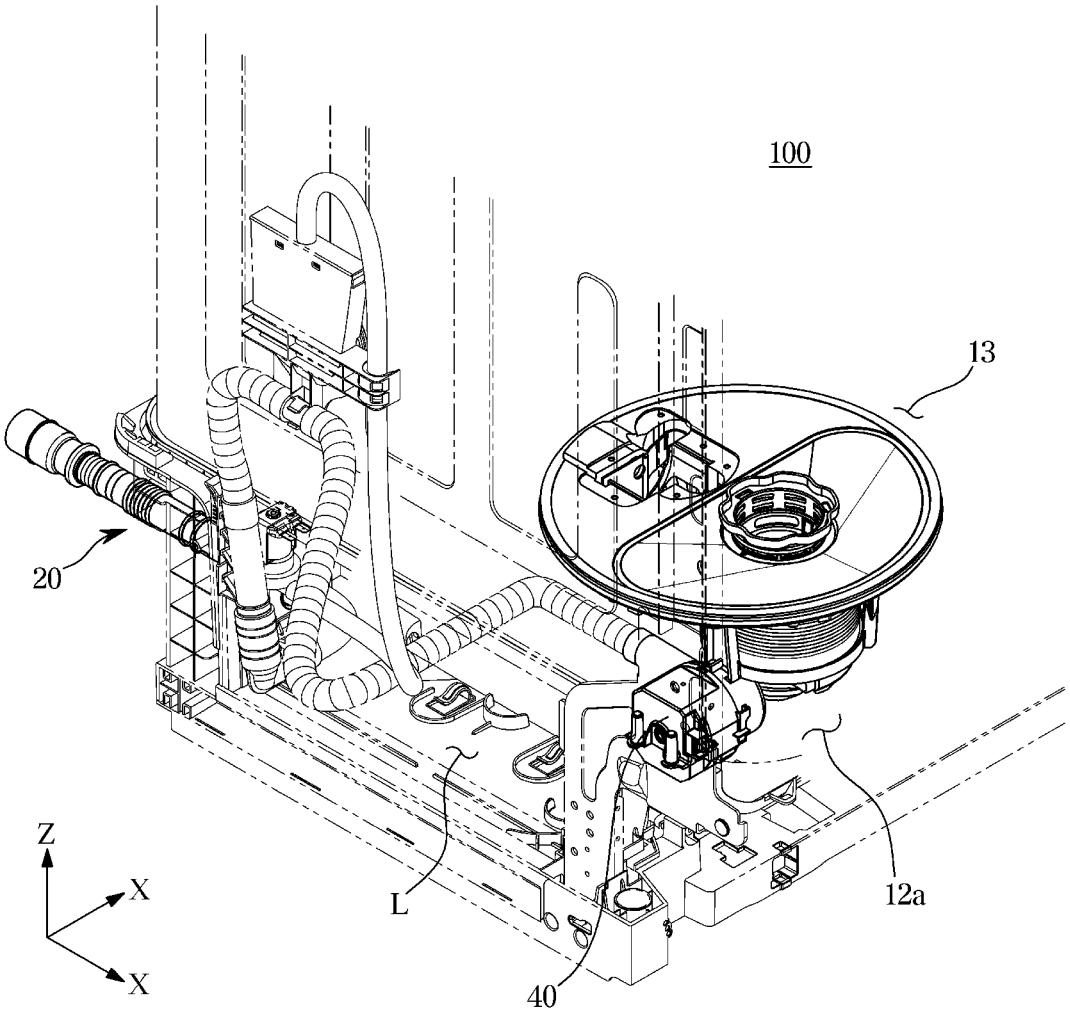
FIG. 3 is a diagram illustrating a structure of a lower portion of a washing chamber of the dishwasher shown in FIG. 1.

FIG. 1 is a schematic perspective view illustrating the dishwasher 1 according to an embodiment of the disclosure. FIG. 2 is a cross-sectional view illustrating the dishwasher 1 shown in FIG. 1. FIG. 3 is a diagram illustrating a structure of a lower part of a washing chamber C of the dishwasher 1 shown in FIG. 1.

Referring to FIGS. 1 and 2, the dishwasher 1 may include a main body 10 forming the external appearance. The dishwasher 1 may further include a tub 12 provided inside the main body 10. The tub 12 may be provided in an approximately box shape. The tub 12 may have one side thereof open. That is, the tub 12 may have an opening portion 12*a*. As an example, the front surface of the tub 12 may be open.

The dishwasher 1 may further include a door 11 provided to open and close the opening portion 12*a* of the tub 12. The door 11 may be installed in the main body 10 to open and close the opening portion 12*a* of the tub 12. The door 11 may be rotatably installed on the main body 10.

The dishwasher 1 may further include a storage container provided inside the tub 12 to accommodate dishware.

The storage container may include a plurality of baskets 51, 52 and 53. The plurality of baskets 51, 52 and 53 may accommodate relatively large dishware, However, the types of dishware stored in the plurality of baskets 51, 52, and 53 are not limited thereto. That is, not only dishware having a relatively large volume but also dishware having a relatively small volume may be accommodated in the plurality of baskets 51, 52, and 53.

The plurality of baskets 51, 52, and 53 include an intermediate basket 52 located at a middle portion in the height direction of the dishwasher 1, and a lower basket 51 located at a lower portion in the height direction of the dishwasher 1. The intermediate basket 52 may be provided to be supported by an intermediate guide rack 13*a*, and the lower basket 51 may be provided to be supported by a lower guide rack 13*b*. The intermediate guide rack 13*a* and the lower guide rack 13*b* may be installed on side surfaces 12*d* of the tub 12 so as to be slidable toward the opening portion 12*a* of the tub 12. The side surfaces 12*d* of the tub 12 may be a concept including an inner surface of a right wall of the tub 12 and an inner surface of a left wall of the tub 12.

The storage container may include an upper basket 53 positioned at an upper portion in the height direction of the dishwasher 1. The upper basket 53 may be provided in the form of a rack assembly to accommodate dishware having a relatively small volume. Preferably, cooking utensils or cutlery, such as ladles, knives, and flippers, may be accommodated in the upper basket 53. In addition, a small cup, such as an espresso cup, may be accommodated in the rack assembly. However, the types of dishware accommodated in the upper basket 53 are not limited thereto.

In addition, the disclosure is not limited to the above, and the upper basket 53 may be omitted depending on the size of the tub 12. Therefore, the storage container may be implemented only with the intermediate basket 52 and the lower basket 51.

Referring to FIGS. 1 to 4, the dishwasher 1 may further include a sump assembly 100 for storing washing water. The dishwasher 1 may include a washing chamber C, which is a space formed by the interior of the tub 12.

The washing room C is a space in which dishware mounted on the baskets 51, 52, and 53 are washed by the washing water and dried. The washing chamber C may be defined as an inner space of the tub 12 formed by the side surfaces 12*d* of the tub 12, the front and rear surfaces of the tub 12, a bottom surface 12*b* of the tub 12, and the sump assembly 100 communicating with the bottom surface 12*b*.

The dishwasher 1 may further include spray units 41, 42 and 43 provided to spray washing water. The spray units 41, 42 and 43 include a first spray unit 41 disposed below the lower basket 51 in the height direction of the dishwasher 1, a second spray unit 42 disposed below the intermediate basket 52 in the height direction of the dishwasher 1, and a third spray unit 43 disposed above the upper basket 53 in the height direction of the dishwasher 1.

The first spray unit 41 may be provided to be rotatable about a rotation shaft 41*a*, the second spray unit 42 may be provided to be rotatable about a rotation shaft 42*a*, and the third spray unit 43 may be provided to be rotatable about a rotation shaft 43*a*.

However, the disclosure is not limited to the embodiment, and the first spray unit 41 may be provided to be fixed to one side of the bottom surface 12*b* unlike the second spray unit 42 and the third spray unit 43. In this case, the first spray unit 41 is provided to spray the washing water in an approximately horizontal direction by a fixed nozzle, and the washing water sprayed in the horizontal direction from the nozzle of the first spray unit 41 may be deflected by a direction change assembly disposed inside the washing chamber C and thus proceed upwards. The direction change assembly may be installed on a rail by a holder, and may be provided to be translatable along the rail.

The third spray unit 43 may spray washing water toward the dishware stored in the upper basket 53, the intermediate basket 52, and the lower basket 51, and the second spray unit 42 may spray washing water toward the dishware stored in the intermediate basket 52 and the upper basket 53.

Unlike the second spray unit 42 and the third spray unit 43, the first spray unit 41 may be disposed on the bottom surface 12*b* of the tub 12. In detail, the first spray unit 41 may be provided to be fixed to the sump assembly 100.

The dishwasher 1 may include a circulation pump 30 that pumps water stored in the sump assembly 100 to the spray units 41, 42, and 43. The washing water pumped by the circulation pump 30 may flow to an alternating device 80 connected to the circulation pump 30 such that the washing water may be supplied to the first spray unit 41 or may be moved upward by the duct 90 and supplied to the second spray unit 42 or the third spray unit 43.

As described above, the washing water stored in the sump assembly 100 or the washing water flowing from the outside into the dishwasher 1 may be caused to flow to the alternating device 80 by the circulation pump 30.

Referring to FIG. 2, the alternating device 80 may supply washing water to the first spray unit 41 through a connector 81 connected to the first spray unit 41, and may supply washing water to the duct 90 through a passage 62 connected to the duct 90.

The alternating device 80 may selectively provide washing water to at least one of the connector 81 and the duct 90.

At least a portion of the connector 81 and the passage 62 may be disposed in a machine room L provided below the washing chamber C. That is, at least a portion of the connector 81 and the passage 62 may be disposed below the bottom surface 12*b* of the tub 12 in the height direction of the dishwasher 1. The washing water may flow to the first spray unit 41 and the duct 90 disposed inside the washing chamber C through the connector 81 and the passage 62. The washing water may flow to the second spray unit 42 and the third spray unit 43 through the duct 90.

Referring to FIG. 3, the dishwasher 1 may include the machine room L disposed below the tub 12. The machine room L may be formed by a lower frame 200.

In the machine room L, the circulation pump 30, the alternating device 80, and the sump assembly 100 described above may be disposed.

The dishwasher 1 may include a drain hose 20 provided to drain the washing water remaining in the tub 12.

The drain hose 20 is connected to the sump assembly 100 to drain the washing water stored in the sump assembly 100 to the outside of the dishwasher 1.

As described above, the washing water collected in the sump assembly 100 may be filtered a filter inside the sump assembly, and then circulated back into the washing chamber C by the circulation pump 30.

However, referring to FIG. 3, when drainage of the washing water is required inside the washing chamber C, the washing water collected in the washing chamber C and the sump assembly 100 may be drained outside through the drain hose 20.

The tub 12 may include a drain pump 40 that pumps the washing water such that the washing water collected in the tub 12 is drained to the outside of the tub 12 through the drain hose 20.

When the drainage process starts, the drain pump 40 is driven such that the washing water collected in the tub 12 may be moved to the outside of the dishwasher 1 through the drain hose 20.

The sump assembly 100 is provided below the washing chamber C to store washing water. A bottom surface 13 of the washing chamber C is inclined to face the sump assembly 100 so that the washing water may be collected in the sump assembly 100 along the bottom surface 13.

Figure 4:
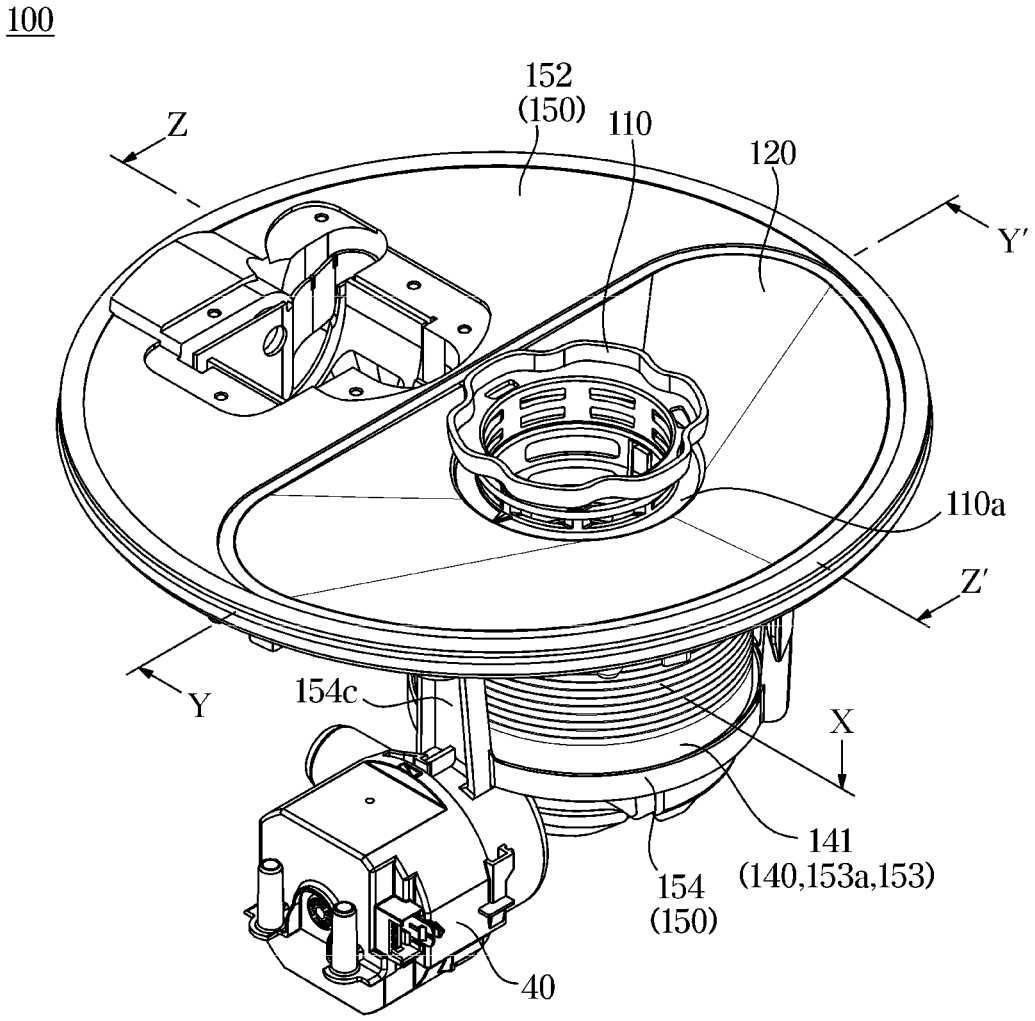
FIG. 4 is a diagram illustrating a sump assembly of the dishwasher shown in FIG. 1.
Figure 5:
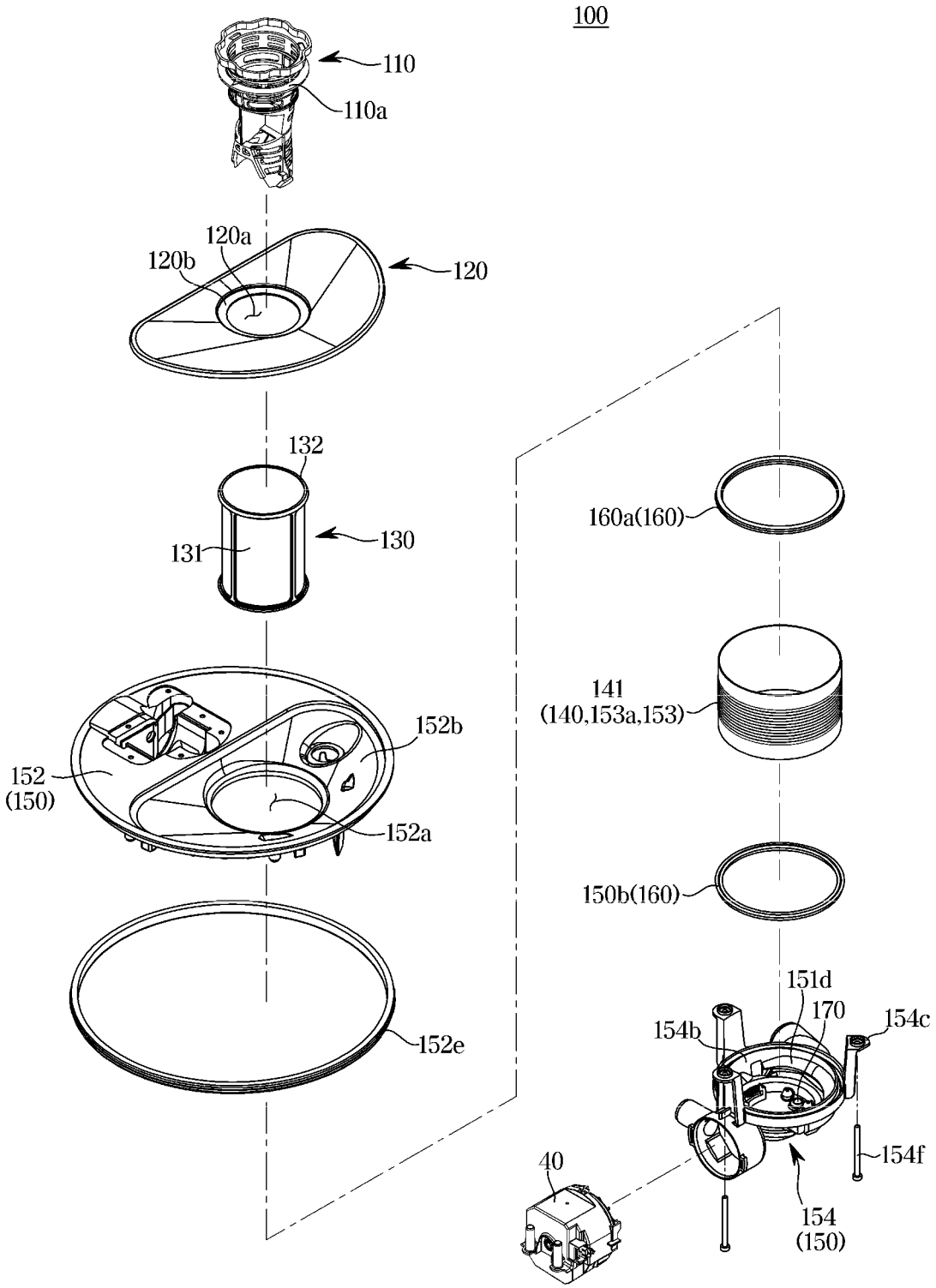
FIG. 5 is an exploded perspective view illustrating the configuration of the sump assembly of the dishwasher shown in FIG. 1.

Referring to FIGS. 4 and 5, the sump assembly 100 includes a sump housing 150, a water storage chamber (151 in FIG. 9) provided inside the sump housing 150, and a plurality of filters for filtering out dirt contained in the washing water.

Moreover, the plurality of filters include a coarse filter 110 having a large through hole, a fine filter 120 having a medium through hole, and a micro filter 130 having a small-size through hole. In particular, the micro filter 130 forms a drain chamber 151*b* that collects dirt and discharges the collected dirt along with the washing water when draining the washing water.

Specifically, the micro filter 130 may be formed in a cylindrical shape having a top and a bottom thereof open so as to be filter out small-sized dirt.

The course filter 110 may be installed through the open top of the micro filter 130 and configured to filter out dirt having particles of a predetermined size or larger before the dirt reaches the micro filter 130.

The fine filter 120 may have a filter hole that is larger than that of the micro filter 130 and smaller than that of the coarse filter 110 and cover the upper portion of the sump housing 150. The course filter 110 is formed in a lattice shape to filter out dirt of a certain size or more, and is detachably installed on the open top of the micro filter 130.

Referring to FIG. 5, the micro filter 130 has a filter membrane 131 that passes water while blocking fine dirt contained in the water and a frame 132 formed in a lattice shape such that the filter membrane 131 is maintained in a cylindrical shape.

In the above-described micro filter 130, the filter membrane 131 has a dense structure, such as a fiber to filter out fine dirt.

A detailed configuration of the sump assembly 100 will be described below.

Figure 6:
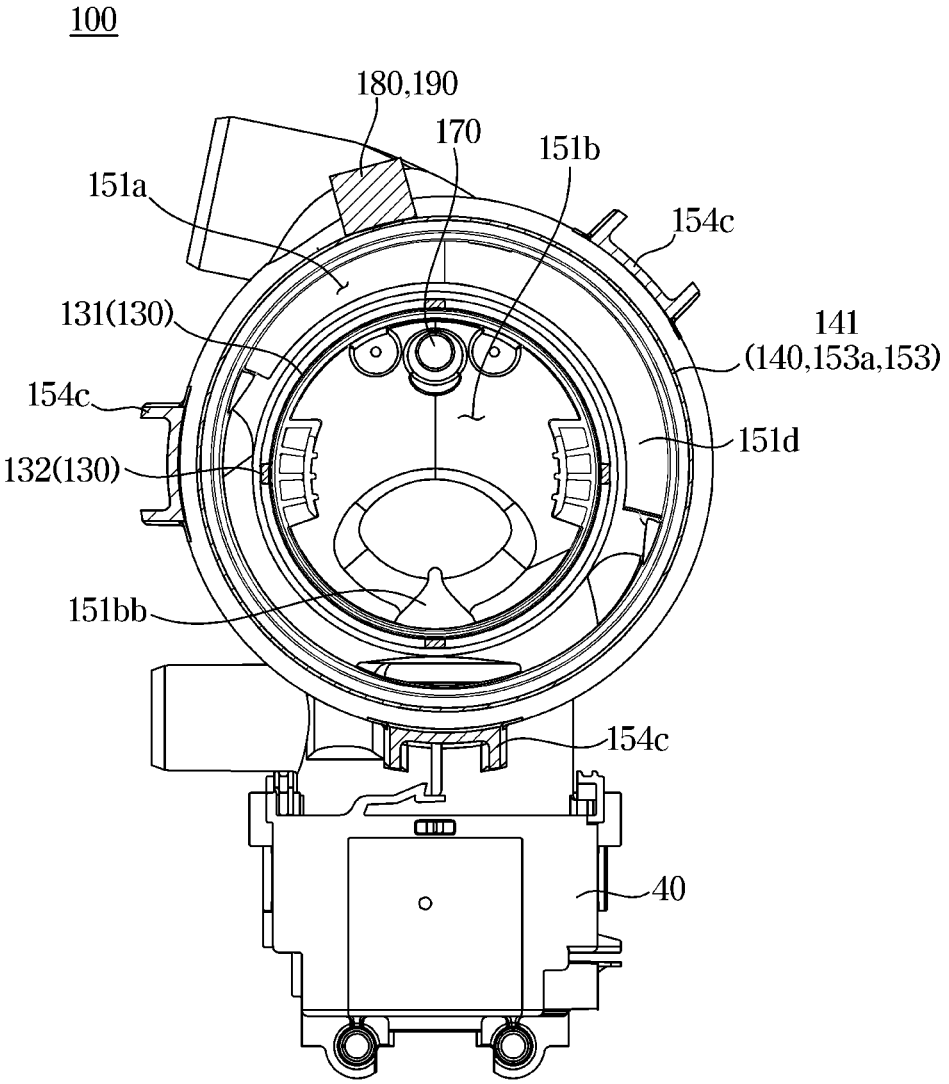
FIG. 6 is a cross-sectional view taken along line X-X' of FIG. 4.
Figure 7:
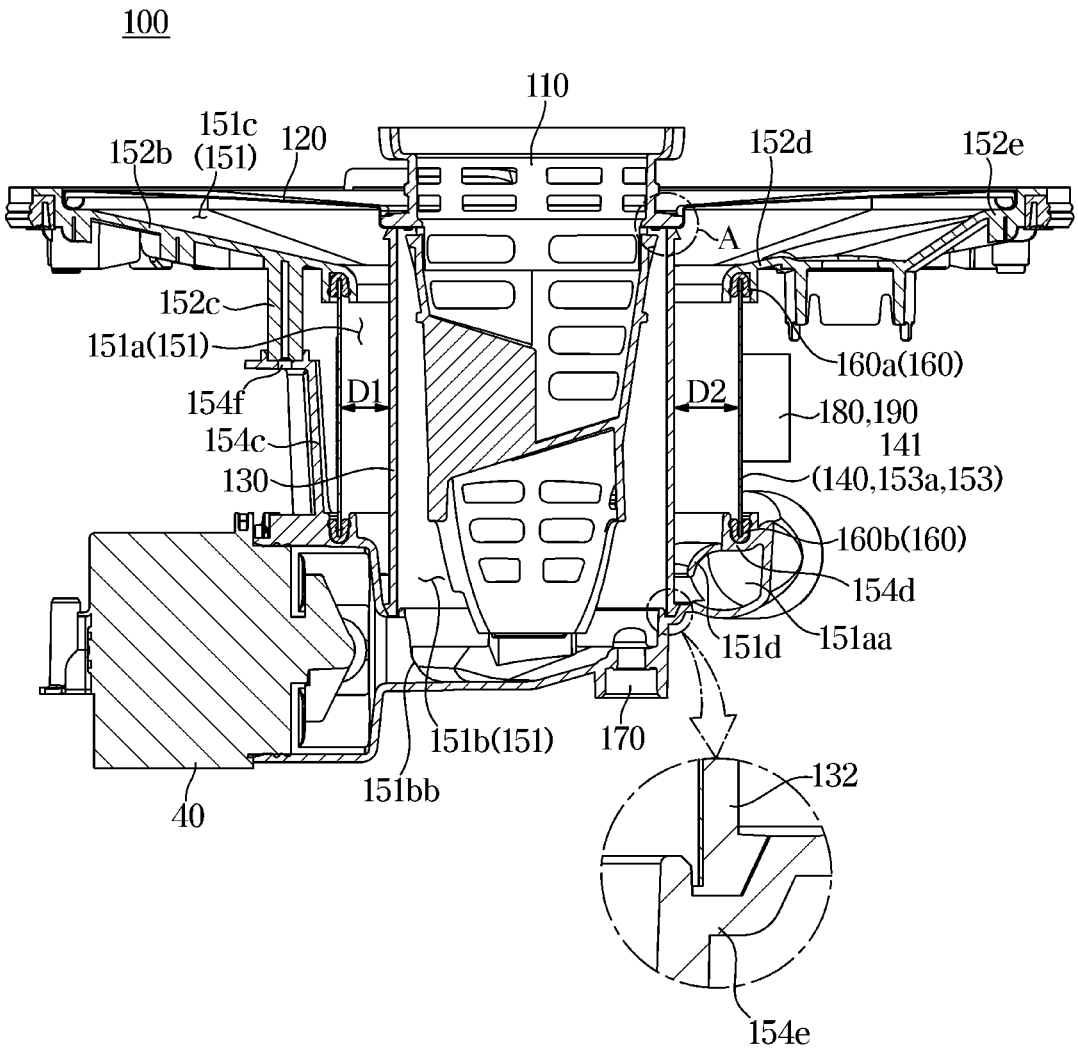
FIG. 7 is a cross-sectional view taken along line Y-Y' of FIG. 4.
Figure 8:
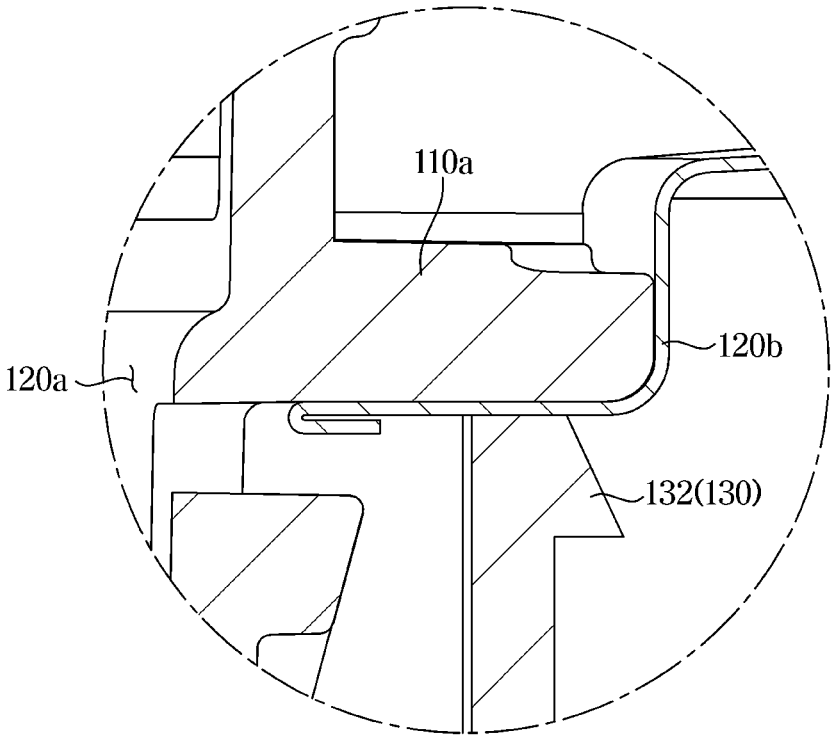
FIG. 8 is an enlarged view illustrating area A of FIG. 7.

FIG. 4 is a diagram illustrating the sump assembly 100 of the dishwasher 1 shown in FIG. 1. FIG. 5 is an exploded perspective view illustrating the configuration of the sump assembly 100 of the dishwasher 1 shown in FIG. 1. FIG. 6 is a cross-sectional view taken along line X-X' of FIG. 4. FIG. 7 is a cross-sectional view taken along line Y-Y' of FIG. 4. FIG. 8 is an enlarged view illustrating area A of FIG. 7.

Figure 9:
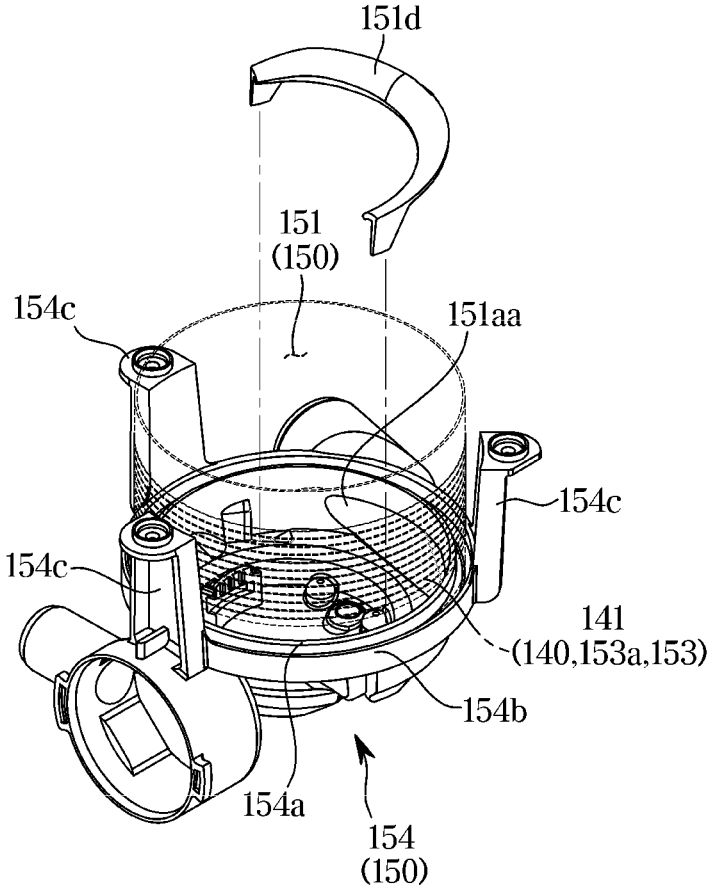
FIG. 9 is an exploded perspective view illustrating the configuration of a lower sump housing shown in FIG. 5.

The sump assembly 100 of the dishwasher according to the embodiment of the disclosure includes the sump housing 150 having the water storage chamber (151 in FIG. 9) for storing washing water, the fine filter 120 provided on the sump housing 150, the coarse filter 110 provided in a cylindrical shape and mounted in an opening 120*a* of the fine filter 120, and the micro filter 130 provided inside the water storage chamber (151 in FIG. 9).

Referring to FIGS. 4 and 5, the sump housing 150 may have an approximately hemispherical shape having a top surface thereof open. The sump housing 150 includes a sidewall portion 153*a* and a bottom portion 154*a* forming the water storage chamber (151 in FIG. 9). The water storage chamber (151 in FIG. 9) is formed in a space surrounded by the sidewall portion 153*a* and the bottom portion (154*a* in FIG. 9) of the sump housing 150, and has a top surface thereof open. The sidewall portion 153*a* forming the water storage chamber (151 in FIG. 9) may be used as the same meaning as an inner side of an intermediate sump housing 153 to be described below. The bottom portion (154*a* in FIG. 9) forming the water storage chamber 151 may be used as the same meaning as a bottom surface located inside the lower sump housing 154.

Referring to FIGS. 6 and 7, the water storage chamber 151 inside the sump housing 150 may be divided into a circulation chamber 151*a* and a drain chamber 151*b*. The circulation chamber 151*a* may be connected to a circulation passage (not shown), and the drain chamber 151*b* may be connected to a drain passage (not shown). The sump housing 150 may further include an auxiliary port 170. A turbidity sensor and an air discharge hose may be connected to the auxiliary port 170 as needed.

As shown in FIG. 5, the sump housing 150 may include an upper sump housing 152, an intermediate sump housing 153, and a lower sump housing 154.

The upper sump housing 152 may be referred to as a first sump housing, the intermediate sump housing 153 may be referred to as a third sump housing, and the lower sump housing 154 may be referred to as a second sump housing.

Referring to FIGS. 5 and 7, the upper sump housing 152 may be disposed at the upper end of the water storage chamber (151 in FIG. 9), and include an inclined portion 152*b* guiding washing water into the water storage chamber 151 and an opening 152*a* communicating the washing chamber C with the water storage chamber 151. The lower sump housing 154 may be provided to have a top surface thereof open and may form the bottom portion 154*a* of the water storage chamber 151. The intermediate sump housing 153 may be provided to connect the upper sump housing 152 to the lower sump housing 154 while forming the sidewall portion 153*a*.

The intermediate sump housing 153 may be provided in the form of a cylinder having a top and a bottom thereof open. However, the shape of the intermediate sump housing 153 is not limited thereto, and the intermediate sump housing 153 may be provided in various shapes as long as it has a top and a bottom thereof open to connect the upper sump housing 152 and the lower sump housing 154 while forming the sidewall portion 153*a*.

The inclined portion 152*b* of the upper sump housing 152 for guiding the washing water into the water storage chamber 151 and the opening 152*a* of the upper sump housing 152 communicating with the inclined portion 152*b* may be provided in a shape corresponding to the shape of the top surface of the intermediate sump housing 153. The upper sump housing 152 may be provided at a bottom surface thereof with an upper groove 152*d* that is formed along the opening 152*a* and in which the upper end of the intermediate sump housing 153 is seated. The upper sump housing 152 may be provided with an upper sump housing sealing 152*e* formed at a lower end of an outermost rim area thereof. The upper sump housing sealing 152*e* may seal such that no gap is generated between the upper sump housing 152 and the bottom surface 13. The upper sump housing sealing 152*e* is configured to prevent washing water from leaking into the machine room L.

The open top surface of the lower sump housing 154 may be provided in a shape corresponding to the shape of the bottom surface of the intermediate sump housing 153. The lower sump housing 154 may be provided with a lower groove 154*d* which is formed along an upper rim thereof and in which a lower end of the intermediate sump housing 153 is seated.

As shown in FIGS. 5 and 7, ring-shaped sealing members 160*a* and 160*b* are seated in the upper groove 152*d* of the upper sump housing 152 and the lower groove 154*d* of the lower sump housing 154. The sealing members 160*a* and 160*b* may be seated in the upper groove 152*d* and the lower groove 154*d*, respectively, and when the sealing members 160*a* and 160*b* are pressed, the intermediate sump housing 153 may be connected to the upper sump housing 152 and the lower sump housing 154. The sealing member 160 seated in the upper groove 152*d* may be defined as an upper sealing member 160*a*, and the sealing member 160 seated in the lower groove 154*d* may be defined as a lower sealing member 160*b*. The intermediate sump housing 153 may be connected to the upper sump housing 152 and the lower sump housing 154 to form the water storage chamber 151. That is, the water storage chamber 151 may be provided as a space surrounded by the sidewall portion 153*a* of the intermediate sump housing 153 and the bottom portion 154*a* provided in the lower sump housing 154, and may have a top surface thereof open.

The sealing members 160*a* and 160*b* may include a rubber material having heat resistance. Alternatively, the sealing members 160*a* and 160*b* may include other material that has a heat resistance, and forms an airtight structure that does not leak water from the connection part when the intermediate sump housing 153 is connected to the upper sump housing 152 and the lower sump housing 154.

As shown in FIG. 7, the lower sump housing 154 includes the bottom portion 154*a* formed with a fitting groove 154*e* into which the lower end of the micro filter 130 is fitted. The upper end of the micro filter 130 may be provided to contact the opening 120*a* of the fine filter 120.

Specifically, the lower end of the cylindrical frame 132 of the micro filter 130 may be fitted into the fitting groove 154*e* provided in the bottom portion 154*a* of the lower sump housing 154. The fitting groove 154*e* may be formed to have a width gradually decreasing as being directed downward. With such a configuration, the micro filter 130 may be easily inserted into the fitting groove 154*e* provided at the bottom portion of the lower sump housing 154.

Referring to FIG. 8, the upper portion of the cylindrical frame 132 of the micro filter 130 may be provided to come in contact with a fine filter flange 120*b* that provides a step portion forming the opening 120*a* of the fine filter 120. The opening 120*a* of the fine filter 120 is provided with the fine filter flange 120*b* that is stepped downward from the opening 120*a*. The course filter 110 may be provided with an engaging flange 110*a*.

As shown in FIGS. 7 and 8, the upper portion of the stepped fine filter flange 120 is brought into contact with and supported by the engaging flange 110*a* of the course filter 110 while the lower portion of the stepped fine filter flange 120 is brought into contact with and supported by the cylindrical frame 132 of the micro filter 130. That is, the engaging flange 110*a* of the course filter 110, the stepped fine filter flange 120*b*, and the upper portion of the cylindrical frame 132 of the micro filter 130 may sequentially arranged while in contact with each other. As the three components come into contact with each other without a gap therebetween, dirt is prevented from flowing into the circulation chamber (151*a* in FIG. 7).

As the micro filter 130 is fitted and coupled to the lower sump housing 154, sealing is ensured between the micro filter 130 and the sump housing 150, and dirt is prevented from passing through a coupling portion between the micro filter 130 and the lower sump housing 154. As the micro filter 130 comes into contact with the stepped flange 120*b* forming the opening 120*a* of the fine filter 120, a sealing between the micro filter 130 and the fine filter 120 is ensured and dirt is prevented from passing through the connecting portion between the micro filter 130 and the fine filter 120.

As shown in FIGS. 5 and 7, the upper sump housing 152 may include a first coupling portion 152*c* protruding from the body of the upper sump housing 152. The lower sump housing 154 may include a second coupling portion 154*c* protruding from a body 154*b* of the lower sump housing 154.

The first coupling portion 152*c* and the second coupling portion 154*c* are coupled to each other through a coupling member 152*f* so that the upper sump housing 152, the intermediate sump housing 153, and the lower sump housing 154 are firmly fixed. When the first coupling portion 152*c* and the second coupling portion 154*c* are coupled through the coupling member 152*f*, the ring shaped sealing members 160 seated in the upper groove 152*d* of the upper sump housing 152 and the lower groove 154*d* of the lower sump housing 154 are further pressed, thereby improving airtightness.

In FIG. 5, each of the first coupling portion 152*c* and the second coupling portions 154*c* is illustrated in three units thereof, but the number of the first coupling portion 152*c* and the second coupling portions 154*c* is not limited thereto as long as the upper sump housing 152, the intermediate sump housing 153, and the lower sump housing 154 can firmly fixed. The coupling member 152*f* may be provided as a screw or other various members, as long as it can firmly couple the first coupling portion 152*c* and the second coupling portion 154*c*, such as screws.

As shown in FIG. 7, when the micro filter 130 is fitted into the lower sump housing 154 and brought into contact with the opening 120*a* of the fine filter 120, the water storage chamber 151 may be divided into the drain chamber 151*b* and the circulation chamber 151*a* by the micro filter 130. The drain chamber 151*b* may be connected with the drain pump 40, and the circulation chamber 151*a* may be connected with the circulation pump 30.

Hereinafter, the structure of the course filter 110 disposed in the drain chamber 151*b* as well as the drain chamber 151*b* will be described in detail with reference to FIGS. 6, 7 and 9.

Since the course filter 110 is provided so that the lower portion thereof protrudes into the drain chamber 151*b*, the washing water passing through the course filter 110 and dirt contained in the washing water flow into the drain chamber 151*b*.

Figure 10:
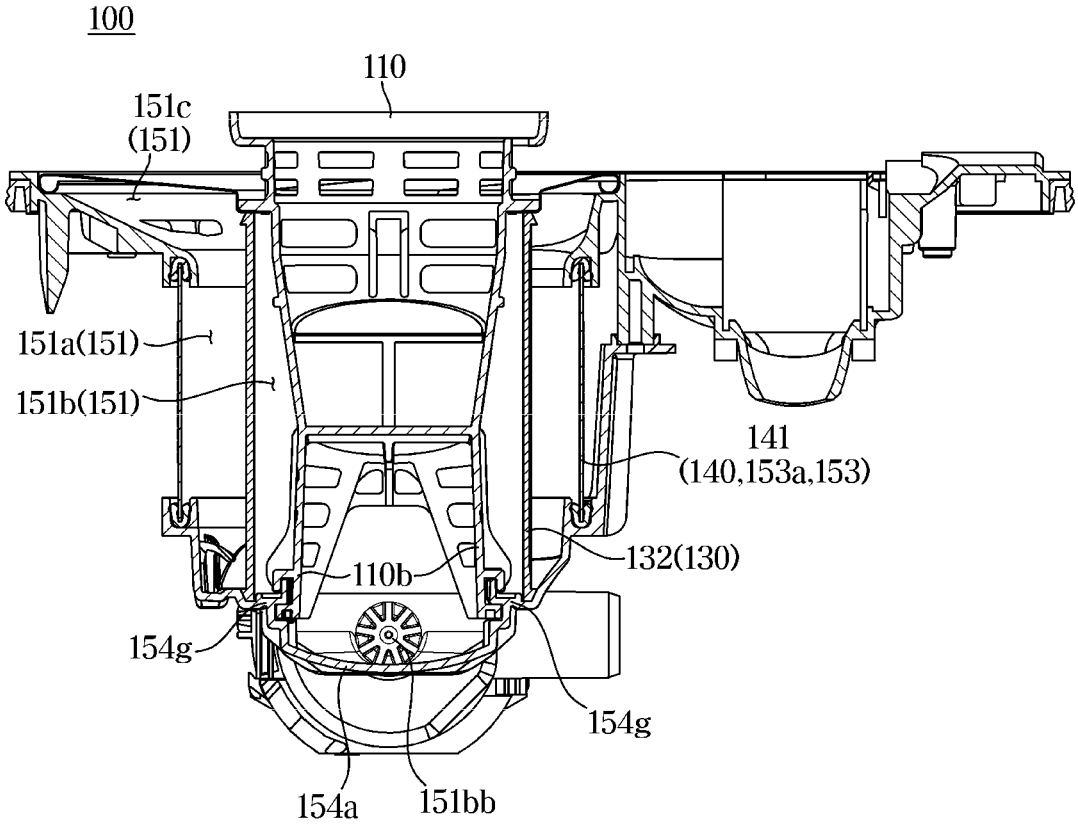
FIG. 10 is a cross-sectional view taken along line Z-Z' of FIG. 4.

As shown in FIG. 10, the coarse filter 110 may be provided with a coarse filter fixing portion 110*b* at a lower portion thereof. A protrusion 154*g* that is elastically coupled to the course filter fixing portion 110*b* may be provided from the bottom portion 154*a* of the lower sump housing 154. The course filter 110 may be supported while the engaging flange 110*a* of the course filter 110 comes in contact with the upper end of the stepped fine filter flange 120*b* (see FIG. 8), and may be more firmly disposed while the course filter fixing portion 110*b* is elastically coupled to the above-described protrusion 154*g*.

Since the course filter fixing portion 110*b* and the above-described protrusion 154*g* are elastically coupled to each other, when a user applies an upward force to the course filter 110 for disassembling and cleaning, the lower end of the course filter 110 is elastically deformed, and the above described elastic coupling of the course filter fixing portion 110*b* and the protrusion 154*g* may be released. When the user continuously applies upward force to the course filter 110, the engaging flange 110*a* of the course filter 110 may be separated from the stepped fine filter flange 120*b* which the engaging flange 110*a* has been come in contact with and supported on.

As shown in FIG. 7, the washing water introduced into the drain chamber 151*b* may flow into the circulation chamber 151*a* by passing through the micro filter 130. However, since the dirt contained in the washing water introduced into the drain chamber 151*b* is primarily filtered by the course filter 110 and is secondarily filtered through the micro filter 130, the dirt remains in the drain chamber 151*b* without flowing into the circulation chamber 151*a*.

When the drain pump 40 is operated, the dirt collected in the drain chamber 151*b* may pass through a drain passage inlet 151*bb* together with the washing water, and then flow outside of the main body 10.

The micro filter 330 needs to come in close contact with the fitting groove 154*e* of the bottom portion 154*a* of the lower sump housing 154 to prevent the dirt in the drain chamber 151*b* from flowing into the circulation chamber 151*a* through a gap between the micro filter 130 and the lower sump housing 154. In order to prevent the dirt in the drain chamber 151*b* from flowing into the circulation chamber 151*a* through the gap between the micro filter 130 and the fine filter 120, the lower end of the stepped fine filter flange 120*b* needs to come in close contact with the upper end of the cylindrical frame 132 of the micro filter 130.

Hereinafter, a specific structure of the circulation chamber 151*a* will be described with respect to FIGS. 6 and 7.

The circulation chamber 151*a* may be formed by an outer circumferential surface of the micro filter 130, an inner circumferential surface of the intermediate sump housing 153, and a portion of the lower sump housing (154 in FIG. 9). At the upper end of the circulation chamber 151*a*, an inflow chamber (151*c* in FIG. 7), which is a space formed by the inclined portion 152*b* of the upper sump housing 152, the fine filter 120, and the upper end of the micro filter 130, may be located.

Referring to FIG. 7, a length in the vertical direction of the micro filter may be provided to be longer than a length in the vertical direction of the intermediate sump housing 153. After the lower end of the cylindrical frame 132 of the micro filter 130 is fitted into the fitting groove 154*e* provided in the bottom portion 154*a* of the lower sump housing 154, the upper end of the micro filter 130 may be disposed to be higher than the upper end of the intermediate sump housing 153. The inflow chamber 151*c* may be formed by the inclined portion 152*b* of the upper sump housing 152, the fine filter 120, and the upper end of the micro filter 130.

The washing water flowing into the circulation chamber 151*a* includes washing water that is filtered by the fine filter 120 and directly introduced into the inflow chamber 151*c* without flowing into the micro filter 130 and washing water that is introduced into the micro filter 130 and then is filtered by the micro filter 130 before flowing. The washing water introduced into the circulation chamber 151*a* passes through a circulation passage inlet 151*aa* provided in the lower sump housing 154 and the circulation pump 30, and then via a circulation passage (not shown), circulates through the spray units 41, 42, and 43.

FIG. 9 is an exploded perspective view illustrating the configuration of the lower sump housing 154 shown in FIG. 5.

As illustrated in FIG. 9, a circulation chamber flow guide 151*d* may be provided such that the washing water flowing into the circulation chamber 151*a* is smoothly introduced from the circulation chamber 151*a* to the circulation passage inlet 151*aa*. The circulation chamber flow guide 151*d* may be provided around the circulation passage inlet 151*aa* and have a length approximately half the circumference of the lower sump housing 154. The circulation chamber flow guide 151*d* has a shape of a side surface open-curved pipe together with the circulation passage inlet 151*aa*, so that the washing water flowing into the circulation chamber 151*a* is constantly circulated without generating turbulence.

As shown in FIGS. 6, 7 and 10, the circulation chamber 151*a* may be configured in a shape in which two eccentric circles overlap when viewed from the top. The central axis of the intermediate sump housing 153 may be positioned out of the central axis of the micro filter 130. Referring to FIG. 7, the circulation chamber 151*a* may be formed such that a length of D1 is shorter than a length of D2.

When a flow area of the circulation chamber 151*a* adjacent to the circulation passage inlet 151*aa* is ensured wide, the flow rate of the washing water flowing through the circulation passage (not shown) in the dishwasher 1 may be increased. The ratio of the diameter of the micro filter 130 to the diameter of the intermediate sump housing 153 may be provided to have a value between 0.5 and 0.8. By having the diameter ratio in a range of 0.5 to 0.8, the flow area of the circulation chamber 151*a* adjacent to the circulation passage inlet 151*aa* may be provided in an appropriate range, and the flow rate of the washing water for sufficient heat exchange may be ensured.

Hereinafter, a heater formed in the intermediate sump housing 153 will be described in detail with reference to FIGS. 5 to 7.

The conventional dishwasher 1 has a heater 140 disposed as a separate component from the sump assembly 100. Alternatively, the heater 140 is coupled to the circulation pump 30 such that the washing water is pumped and heated at the same time before flowing out. Washing water is heated because the high-temperature washing water, when supplied to the sump assembly 100, may easily wash dishware through the spray nozzle. In addition, the heated washing water may decompose dirt present in the sump assembly 100 or the filter, or may sterilize microorganisms.

However, when the sump assembly 100 and the heater 140 are provided as separate components, heat loss may occur in the process of flowing the heated washing water into the sump assembly 100, and when the separate heater 140 is coupled to a pump, the pump may have a pressure loss or the energy efficiency of the pump may be lowered.

As shown in FIGS. 5 to 7, the intermediate sump housing 153, that is, the sidewall portion 153*a* forming the water storage chamber 151 may be configured to include the heater 140. The heater 140 may be provided in a part of the intermediate sump housing 153, but the disclosure is not limited thereto, and the heater 140 may be provided by the entire intermediate sump housing 153. The heater 140 may be provided with a planar heating element 141 such that the heater 140 is formed by the entire intermediate sump housing 153.

The planar heating element 141 may be defined as a metal resistor having electrical resistance or a heating element having a planar shape that converts electrical energy into thermal energy through a heating portion of a ceramic resistor (a carbon layer).

The intermediate sump housing 153, that is, the sidewall portion 153*a* forming the water storage chamber 151 may be formed of the planar heating element 141, which is a heat generating element having a planar shape. Since the intermediate sump housing 153, that is, the sidewall portion 153*a* forming the water storage chamber 151, generates heat, the heat may directly heat up the washing water in the circulation chamber 151*a* and indirectly heat up the washing water in the micro filter 130.

The circulation chamber 151*a* may be formed such that the length of D1 is shorter than the length of D2. By ensuring a wider flow area of the circulation chamber 151*a* adjacent to the circulation passage inlet 151*aa*, the flow rate of the washing water flowing through the circulation passage (not shown) in the dishwasher 1 may be increased. When the flow rate in the circulation chamber 151*a* is increased, heat loss due to heat flowing out of the intermediate sump housing 153, that is, the side wall portion 53*a* forming the water storage chamber may be reduced compared to a case where the flow rate is slow.

Since the intermediate sump housing 153, that is, the side wall portion (153*a* in FIG. 9) forming the water storage chamber 151 generates heat and directly heats up the washing water in the circulation chamber 151*a*, heat loss is remarkably reduced compared to when washing water is heated by a heater 140 separately provided from the sump assembly 100. In addition, since the washing water is caused to flow in the dishwasher 1 without loss of pressure in the pump, the overall power efficiency of the dishwasher 1 may be increased.

Referring to FIGS. 6 to 7, the sump assembly 100 may further include a controller 180 and a sensor 190 disposed outside the intermediate sump housing 153. As shown in FIGS. 6 and 7, the controller 180 and the sensor 190 may be disposed together at a specific position outside the intermediate sump housing 153. Alternatively, the controller 180 and the sensor 190 may be separately provided from each other and disposed at separate locations. The sensor 190 may be installed in the auxiliary port 170 of the sump housing 150 described above. The controller 180 may be configured to control the heater 140 to adjust the temperature of the washing water based on temperature information measured by the sensor 190. The sensor 190 may be configured to measure the temperature of the washing water in the water storage chamber 151. When the washing water is overheated at a temperature exceeding the heat resistance limit of the sealing member 160 or the heat resistance limit of various parts of the dishwasher 1, an abnormal operation may occur. The controller 180 and the sensor 190 may be configured to maintain an appropriate temperature range in which the washing water smoothly performs the washing operation.

As is apparent from the above, since an intermediate sump housing is configured to include a heater (a planar heating element), a separate heater is not required, so that the dishwasher may be provided with a reduced overall volume.

The intermediate sump housing, that is, a sidewall portion of a water storage chamber is configured to include a heater (a planar heating element) such that the washing water in a circulation chamber is directly heated, thereby increasing the thermal efficiency of the dishwasher and reducing pressure loss of the pump.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A dishwasher comprising:

a washing chamber in which water is introduced for items to be washed; and a sump assembly disposed below the washing chamber and configured to collect water from the washing chamber, the sump assembly including a sump housing having a water storage chamber to store the collected water from the washing chamber, and a sidewall portion forming a side portion of the water storage chamber; and a heater provided on the sidewall portion of the sump housing to heat the water stored in the water storage chamber wherein a part of the sidewall portion of the water storage is formed of the heater.

2. The dishwasher of claim 1, wherein the heater includes a planar heating element.

3. The dishwasher of claim 2, wherein the sidewall portion being a cylindrical shape.

4. The dishwasher of claim 1, wherein the sump housing includes an upper sump housing arranged at an upper end portion of the water storage chamber, and the upper sump housing having an inclined portion to guide the water introduced into the washing chamber to the sump assembly and an opening to allow the washing chamber to communicate with water storage chamber;

a lower sump housing forming a bottom portion of the water storage chamber; and an intermediate sump housing connecting the upper sump housing to the lower sump housing, and forming the sidewall portion.

5. The dishwasher of claim 4, wherein the sump assembly includes an upper sealing member arranged at a first connecting portion between the upper sump housing and the intermediate sump housing; and a lower sealing member arranged at a second connecting portion between the intermediate sump housing and the lower sump housing.

6. The dishwasher of claim 5, wherein the upper sump housing includes an upper groove in which the upper sealing member is accommodated, and the lower sump housing includes a lower groove in which the lower sealing member is accommodated, and a first end of the intermediate sump housing and a second end of the intermediate sump housing are seated in the upper groove and the lower groove, respectively.

7. The dishwasher of claim 4, wherein the upper sump housing includes a first coupling portion protruding from a body of the upper sump housing, and the lower sump housing includes a second coupling portion protruding from a body of the lower sump housing to correspond to the first coupling portion, and the first coupling portion and the second coupling portion being fastened to each other through a coupling member so that the upper sump housing, the intermediate sump housing, and the lower sump housing are fixed.

8. The dishwasher of claim 4, further comprising a sprayer configured to spray water to wash the items in the washing chamber, wherein the sump assembly further includes a fine filter provided at an upper side of the sump housing, and the fine filter having an opening to allow the washing chamber to communicate with the water storage chamber;

a coarse filter having a cylindrical shape and mounted in the opening;

a micro filter mounted inside the water storage chamber to form a dirt collecting chamber for collecting dirt together with a part of the bottom portion of the sump housing, and having a cylindrical shape; and a circulation chamber formed by an outer side of the micro filter and the sidewall portion, and configured to circulate the water stored in water storage chamber to the sprayer, wherein the heater heats the water of the circulation chamber.

9. The dishwasher of claim 8, wherein the sump assembly includes the intermediate sump housing eccentrically disposed with respect to the micro filter.

10. The dishwasher of claim 8, wherein the micro filter includes a filter net configured to filter out dirt and a filter frame provided in a cylindrical shape and supporting the filter net, the filter frame has an end accommodated in a micro filter fitting groove provided in the lower sump housing and the filter frame has another end to come in contact with and communicate with the opening of the fine filter, and the micro filter has a vertical length longer than a vertical length of the intermediate sump housing.

11. The dishwasher of claim 8, wherein a ratio of a diameter of the micro filter to a diameter of the intermediate sump housing has a value in a range of 0.5 to 0.8.

12. The dishwasher of claim 1, wherein the sump assembly further includes a sensor configured to measure a temperature of the water in the water storage chamber, and a controller configured to adjust a temperature of the heater.

13. A sump assembly for storing water from a dishwasher, the sump assembly comprising:

a water storage chamber configured to store the water from the dishwasher;

a first sump housing arranged at an upper end portion of the water storage chamber, and the first sump housing having an inclined portion configured to guide the water from the dishwasher into the sump assembly and an opening to allow the washing chamber to communicate with the water storage chamber;

a second sump housing forming a bottom portion of the water storage chamber; and a third sump housing including a planar heating element and the third sump housing connecting the first sump housing to the second sump housing, and forming a sidewall portion of the water storage chamber.

14. The sump assembly of claim 13, wherein the sidewall portion being a cylindrical shape.

15. The sump assembly of claim 13, further comprising:

an upper sealing member arranged at a first connecting portion between the first sump housing and the third sump housing; and a lower sealing member arranged at a second connecting portion between the third sump housing and the second sump housing to prevent water from leaking to an outside of the sub assembly.

16. The sump assembly of claim 15, wherein the first sump housing includes an upper groove in which the upper sealing member is accommodated, the second sump housing includes a lower groove in which the lower sealing member is accommodated, and a first end of the third sump housing and a second end of the third sump are seated in the upper groove and the lower groove, respectively, while pressing the upper sealing member and the lower sealing member.

17. The sump assembly of claim 13, wherein the first sump housing includes a first coupling portion protruding from a body of the first sump housing, and the second sump housing includes a second coupling portion protruding from a body of the second sump housing to correspond to the first coupling portion, and the first coupling portion and the second coupling portion being fastened to each other through a coupling member so that the first sump housing, the second sump housing, and the third sump housing are fixed.

18. The sump assembly of claim 13, wherein the sump assembly further includes:

a fine filter provided at an upper side of the first sump housing, and the fine filter having an opening to allow the washing chamber to communicate with the water storage chamber;

a coarse filter having a cylindrical shape and mounted in the opening;

a micro filter mounted inside the water storage chamber to form a dirt collecting chamber for collecting dirt together with a part of the bottom portion of the second sump housing, and having a cylindrical shape; and a circulation chamber formed by an outer side of the micro filter and the sidewall portion, and configured to circulate the stored water in the water storage chamber to a sprayer configured to spray the stored water such that the dishwasher washes dishware in the dishwasher, wherein the planar heating element heats the water of the circulation chamber.

19. The sump assembly of claim 18, wherein the third sump housing is eccentrically disposed with respect to the micro filter.

20. The sump assembly of claim 13, further comprising a sensor configured to measure a temperature of the washing water in the water storage chamber, and a controller configured to adjust a temperature of the heater.

* * * * *